US007585063B2

(12) United States Patent
Okuda

(10) Patent No.: US 7,585,063 B2
(45) Date of Patent: Sep. 8, 2009

(54) FILTER DEVICE AND LIQUID DROP EJECTING DEVICE

(75) Inventor: Masakazu Okuda, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 539 days.

(21) Appl. No.: 11/440,247

(22) Filed: May 24, 2006

(65) Prior Publication Data

US 2007/0109365 A1 May 17, 2007

(30) Foreign Application Priority Data

Nov. 15, 2005 (JP) ..... 2005-329946

(51) Int. Cl.
*B41J 2/175* (2006.01)

(52) U.S. Cl. ..... 347/86; 347/93

(58) Field of Classification Search ..... 347/85, 347/86, 87, 93

See application file for complete search history.

(56) References Cited

U.S. PATENT DOCUMENTS 5,509,140 A * 4/1996 Koitabashi et al. ..... 347/86
5,546,109 A * 8/1996 Nakano ..... 347/93
6,736,496 B2 * 5/2004 Hanaoka et al. ..... 347/86

FOREIGN PATENT DOCUMENTS

| | | |
|---|---|---|
| JP | 06-286152 | 10/1994 |
| JP | 9-277561 | 10/1997 |
| JP | 10-329330 | 12/1998 |
| JP | 2004-122398 | 4/2004 |
| KR | 10-2000-0040816 | 7/2000 |

* cited by examiner

*Primary Examiner*—Anh T. N. Vo
(74) *Attorney, Agent, or Firm*—Fildes & Outland, P.C.

(57) ABSTRACT

There is provided a filter device having: a supply path into which liquid flows; a first liquid chamber communicating with the supply path; a second liquid chamber communicating with the first liquid chamber; a first discharge path which communicates with the second liquid chamber, and from which liquid is discharged; and a filter provided between the first liquid chamber and the second liquid chamber. An intermediate portion of the first discharge path between an entrance and an exit of the first discharge path is higher than the entrance and the exit, and the entrance of the first discharge path opens in a vicinity of a floor portion of the second liquid chamber.

18 Claims, 16 Drawing Sheets

FIG.5

| # | REQUIRED CHARACTERISTIC/CONDITION | CONVENTIONAL EXAMPLE | PRESENT INVENTION |
|---|---|---|---|
| 1 | PREVENTS REFUSE/FOREIGN MATTER FROM FLOWING INTO JS. | A | A |
| 2 | PREVENTS AIR BUBBLES FROM FLOWING INTO JS (AT TIME OF EJECTION). | A | A |
| 3 | FLOW PATH RESISTANCE IS SMALL. | A | A |
| 4 | BACK PRESSURE CAN BE APPLIED TO JS (SEALED STRUCTURE). | A | A |
| 5 | INITIAL FILLING ABILITY IS GOOD. | C | A |
| 6 | REFILLING ABILITY IS GOOD. | C | A |
| 7 | REMAINING AMOUNT OF AIR BUBBLES WITHIN FU IS SMALL. | B | A |
| 8 | AIR BUBBLES DO NOT FLOW INTO JS AT TIME OF INK SUCTION. | C | A |
| 9 | AIR BUBBLES ACCUMULATING IN FU CAN BE DISCHARGED EASILY. | A | A |
| 10 | AIR BUBBLES ARE NOT DRAWN-IN FROM NOZZLES AT TIME OF INK CIRCULATION. | A | A |
| 11 | ABILITY TO RECOVER FROM AN ABNORMAL STATE IS GOOD. | B | A |
| 12 | DISCHARGE OF INK WITHIN FU IS EASY (CLEANING IS EASY). | C | A |
| 13 | CAN BE STORED IN STATE IN WHICH INK IS FILLED WITHIN FU. | A | A |
| 14 | EXTERNAL SIZE (PLACEMENT SURFACE AREA) IS SMALL. | B | A |
| 15 | CAN BE MANUFACTURED AT LOW COST. | A | A |
| 16 | ASSEMBLY IS EASY. | A | A |
| 17 | INK-RESISTANCE OF MEMBERS IS GOOD. | A | A |
| 18 | GAS BLOCKING ABILITY OF MEMBERS IS GOOD. | A | A |

A: GOOD
B: ACCEPTABLE
C: FAILED

FILTER DEVICE AND LIQUID DROP EJECTING DEVICE

CROSS-REFERENCE TO RELATED APPLICATION

This application claims priority under 35 USC 119 from Japanese patent document, 2005-329946, the disclosure of which is incorporated by reference herein.

BACKGROUND OF THE INVENTION

1. Field of the Invention

The present invention relates to a filter device and a liquid drop ejecting device, and in more detail, to a filter device that removes refuse and foreign matter from liquid, and to a liquid drop ejecting device that ejects, from nozzles of a liquid drop ejecting head, liquid which has passed through the filter device and been supplied.

2. Description of the Related Art

In an inkjet recording device carrying out printing onto a recording medium by ejecting ink drops from nozzles of a recording head, in order to prevent deterioration in the ink ejecting performance or clogging of the nozzles due to refuse and foreign matter existing in the ink, a filter which removes the refuse and foreign matter in the ink is provided on the path by which ink is supplied to the recording head.

On the other hand, in inkjet recording heads in recent years, for the purpose of high-speed printing, there has been the trend to increase the number of nozzles provided at a single recording head, or to make the repetition frequency of ink jetting larger. Further, for the purpose of high image quality printing, the trend toward making the diameter of the nozzle smaller in order to make the jetted ink drop smaller has progressed.

For these reasons, the ability to remove even finer refuse and foreign matter, and a configuration having a small pressure loss, have been required of the aforementioned filter. To this end, trends toward making the mesh of the filter finer and making the surface area of the filter larger have advanced. However, if the surface area of the filter is made to be large, the inkjet recording head becomes large due to the placement of the filter. As a measure for addressing this, it has been thought to suppress the increase in the size of the inkjet recording head by dividing the filter into plural sections and placing the plural sections in parallel.

However, in the above-described structure, the flow path at the downstream side of the filter branches off in plural directions. Therefore, in a case in which an air bubble which has arisen in the ink stops in one of the flow paths, the flow speed in the other flow path increases. The ability to remove (ability to discharge) the air bubble in the flow path in which the air bubble has stopped worsens, which leads to a deterioration in the ink ejecting performance.

FIG. 14 is a drawing which shows, schematically and in a simplified manner, a filter unit (filter device).

As shown in FIG. 14, a filter unit 910 is provided at an ink flow path between an ink tank (not shown) and an inkjet recording head 902. The inkjet recording head 902 ejects ink drops from nozzles (not shown) formed in a nozzle surface 904 onto a recording sheet which is a recording medium, so as to form an image on the recording sheet.

The filter unit 910 has a first ink chamber 912 and a second ink chamber 914. The first ink chamber 912 and the second ink chamber 914 are partitioned by a filter 916.

An ink supply path 924 and an ink circulating path 926 communicate with the first ink chamber 912. An ink feed-out path 930 communicates with the second ink chamber 914. The ink in the ink tank (not shown) is supplied from the ink supply path 924, and is fed to the inkjet recording head 902 from the ink feed-out path 930. Further, the ink in the first ink chamber 912 can circulate to the ink tank from the ink circulating path 926.

Note that the first ink chamber 912 corresponds to an outer chamber, whereas the second ink chamber 914 corresponds to an inner chamber.

First, the discharging of air at the time when ink is initially filled into the filter unit 910 will be described.

As shown in FIGS. 15(*a*) and (*b*), ink is poured into the first ink chamber 912 from the ink supply path 924, and the ink is gradually filled into the first ink chamber 912 and the second ink chamber 914.

At this time, when the lower end portion of the filter 916 which partitions the first ink chamber 912 and the second ink chamber 914 is submerged in the ink, the ink seeps toward the upper portion of the filter 916 due to capillary action. The entire surface of the filter 916 is wet by the ink before the first ink chamber 912 and the second ink chamber 914 are filled with ink.

When the entire surface of the filter 916 is wet by ink, the entry and exit of air between the first ink chamber 912 and the second ink chamber 914 via the filter 916 is impeded. Therefore, air within the second ink chamber 914 cannot be discharged-out through the ink circulating path 926. Accordingly, the air within the second ink chamber 914 can only be discharged-out through the inkjet recording head 902 which has a high discharge resistance.

Thus, as shown in FIG. 15(*c*), the liquid surfaces of the first ink chamber 912 and the second ink chamber 914, which had been maintained the same until then, are no longer the same. The first ink chamber 912, from which air is discharged from the ink circulating path 926 which has low resistance, is filled with ink first.

As shown in FIG. 15(*d*), when the first ink chamber 912 is filled with ink, the pouring of ink into the second ink chamber 914 begins again.

Then, as shown in FIG. 15(*e*), when the liquid surface reaches the height of a feed-out path entrance 930A of the ink feed-out path 930, ink is discharged from the ink feed-out path 930, and the supply of ink to the inkjet recording head 902 begins.

At this time, because the cross-sectional surface area of the ink feed-out path 930 is large, the ink goes along the wall surface of the ink flow path 930 (like a waterfall), and flows into the inkjet recording head 902. In other words, the ink flows into the inkjet recording head 902 in a state in which no meniscus is formed.

Therefore, as shown in FIG. 15(*f*), the ink is fed to the inkjet recording head 902 in a state in which ink and air are mixed together.

A large amount of air K remains at the ceiling portion of the second ink chamber 914. Due to the filter 916, it is difficult for this air K to move to the first ink chamber 912, and therefore, the air K continues to remain in the filter unit 910.

As shown in FIG. 16, because the feed-out path entrance 930A of the ink feed-out path 930 opens in a vicinity of the ceiling portion, the air K which is remaining is in a vicinity of the feed-out path entrance 930A.

Thus, at the time of an ink suction operation which sucks the ink from the nozzles of the inkjet recording head 902, or the like, due to the ink which is flowing as shown by arrow Y9, the air which is remaining becomes fine air bubbles which enter into the ink feed-out path 930 from the feed-out path entrance 930A and flow into the inkjet recording head 902.

When air flows into the inkjet recording head 902 together with the ink in this way, the reliability of the inkjet recording head 902 markedly deteriorates.

Accordingly, it is desirable to make it difficult for air remaining in a filter unit to flow-out.

SUMMARY OF THE INVENTION

The present invention has been made in view of the aforementioned, and provides a filter device and a liquid drop ejecting device which make it difficult for air remaining within the filter device to flow-out.

A filter device of an aspect of the present invention has: a supply path into which liquid flows; a first liquid chamber communicating with the supply path; a second liquid chamber communicating with the first liquid chamber; a first discharge path which communicates with the second liquid chamber, and from which liquid is discharged; and a filter provided between the first liquid chamber and the second liquid chamber, wherein an intermediate portion of the first discharge path between an entrance and an exit of the first discharge path is higher than the entrance and the exit, and the entrance of the first discharge path opens in a vicinity of a floor portion of the second liquid chamber.

BRIEF DESCRIPTION OF THE DRAWINGS

An exemplary embodiment of the present invention will be described in detail based on the following figures, wherein:

FIG. 5 is a table comparing the performances of the filter unit of FIG. 1 and a conventional filter unit with respect to various types of conditions;

DETAILED DESCRIPTION OF THE INVENTION

An exemplary embodiment of the present invention will be described in detail hereinafter with reference to the drawings.

Figure 1:
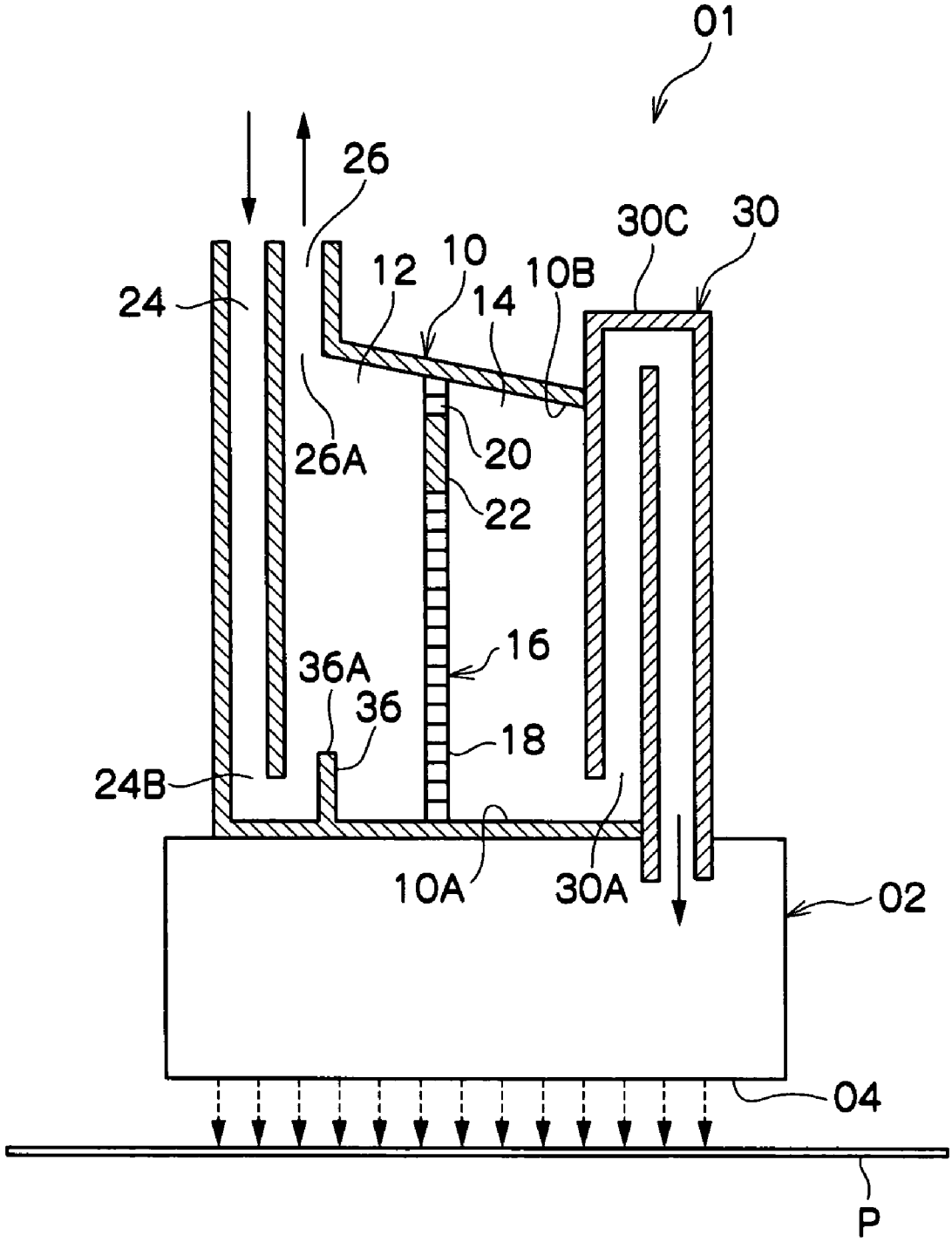
FIG. 1 is a drawing schematically showing the structure of a filter unit relating to an exemplary embodiment of the present invention, and schematically showing main portions of an inkjet recording device using the filter unit.

As shown in FIG. 1, in an inkjet recording device 01, a filter unit 10 is provided at an ink flow path between an ink tank (not shown) and an inkjet recording head 02. The inkjet recording head 02 ejects ink drops (represented by the dotted-line arrows in FIG. 1) from nozzles (not shown) formed in a nozzle surface 04, onto a recording sheet P which is a recording medium, so as to form an image on the recording sheet P.

The filter unit 10 has a first ink chamber 12 and a second ink chamber 14. The first ink chamber 12 and the second ink chamber 14 are partitioned by a filter 16.

The filter 16 vertically partitions the region between a floor portion 10A and a ceiling portion 10B. Accordingly, the filter 16 is disposed at an orientation substantially orthogonal to the nozzle surface 04 of the inkjet recording head 02 in which the nozzles are formed. Therefore, even though the surface area of the filter 16 is made to be large, the surface area projected onto the nozzle surface 04 is not large.

The filter 16 is formed from a lower filter 18 and an upper filter 20, and a partitioning portion 22 is provided therebetween. Note that the partitioning portion 22 is positioned slightly downward from the ceiling portion 10B.

An ink supply path 24 and an ink circulating path 26 communicate with the first ink chamber 12. An ink feed-out path 30 communicates with the second ink chamber 14. Ink of an ink tank (not shown) is supplied from the ink supply path 24, passes through the first ink chamber 12, the filter 16, and the second ink chamber 14, and thereafter, is fed from the ink feed-out path 30 to the inkjet recording head 02. Further, the ink of the first ink chamber 12 can be circulated to the ink tank from the ink circulating path 26.

A supply path exit 24B of the ink supply path 24 opens in a vicinity of above the floor portion 10A. Further, a flow regulating plate 36 stands erect from the floor portion 10A, between the ink supply path 24 and the filter 16. A top portion 36A of the flow regulating plate 36 extends further upward than the supply path exit 24B of the ink supply path 24. Further, a circulating path entrance 26A of the ink circulating path 26 opens in the ceiling portion 10B.

The ink feed-out path 30 is formed overall in the shape of an upside-down "U". A feed-out path entrance 30A of the ink feed-out path 30 opens in a vicinity of above the floor portion 10A. The cross-sectional surface area of the ink feed-out path 30 is greater than or equal to 3 $mm^2$ and less than or equal to 12 $mm^2$.

The ceiling portion 10B is an inclined surface which rises from the second ink chamber 14 toward the first ink chamber 12. The circulating path entrance 26A of the ink circulating path 26 opens at the highest position of the ceiling portion 10B.

The height of a convex peak portion 30C of the ink feed-out path 30 (the highest position of the ink feed-out path 30) is higher than the circulating path entrance 26A of the ink circulating path 26.

Figure 2:
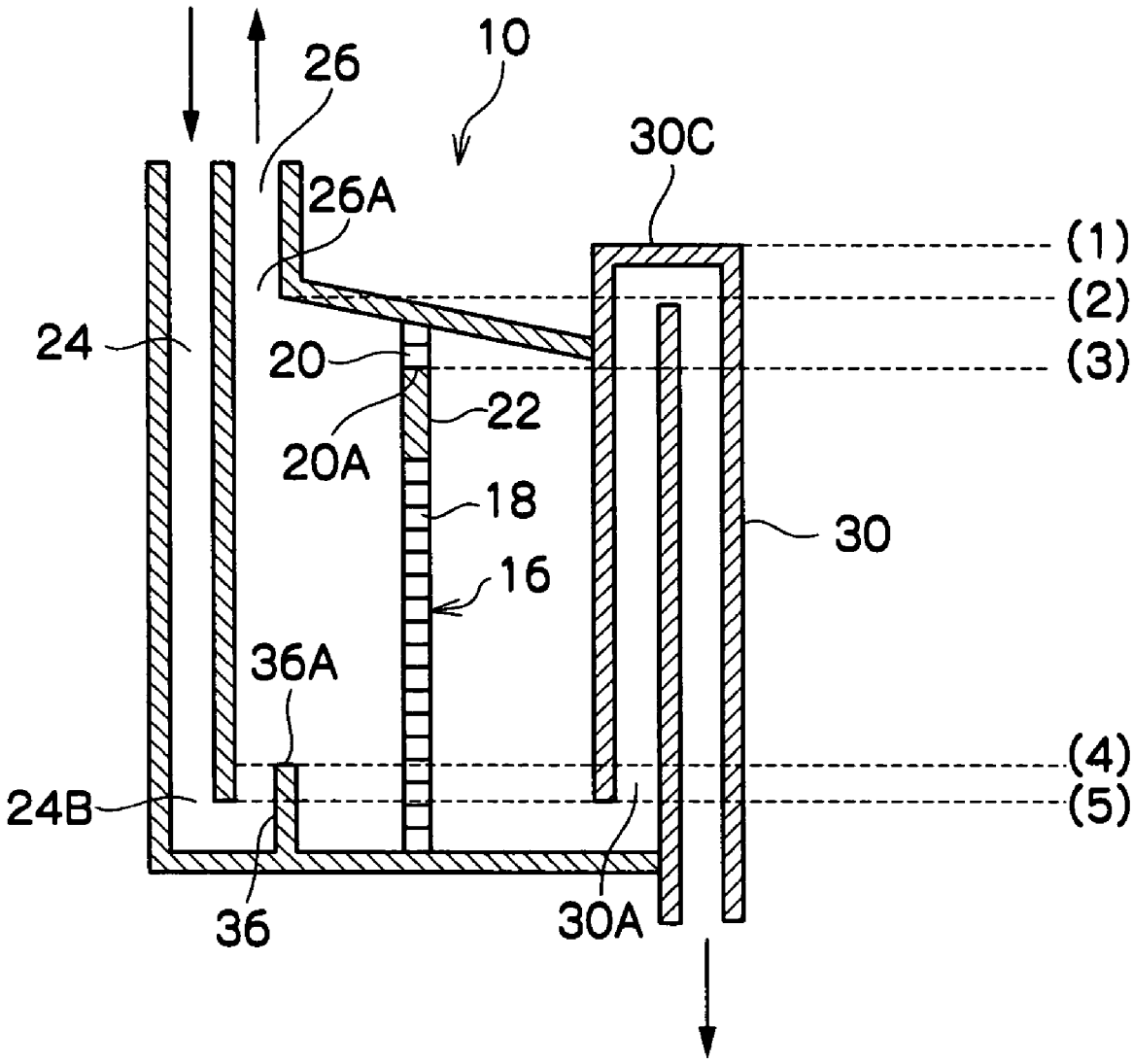
FIG. 2 is a drawing schematically showing the structure of the filter unit relating to the exemplary embodiment of the present invention.

Accordingly, as shown in FIG. 2, the order of heights, from the highest, is as follows: (1) the convex peak portion 30C of the ink feed-out path 30>(2) the circulating path entrance 26A of the ink circulating path 26>(3) a bottom end portion 20A of the upper filter 20, and separated greatly therefrom, (4) the top portion 36A of the flow regulating plate 36>(5) the supply path exit 24B of the ink supply path 24=the feed-out path entrance 30A of the ink feed-out path 30.

Operation of the present exemplary embodiment will be described next.

First, the discharging of air bubbles at the time when ink is initially filled into the filter unit 10 (initial filling) will be described.

Figure 3:
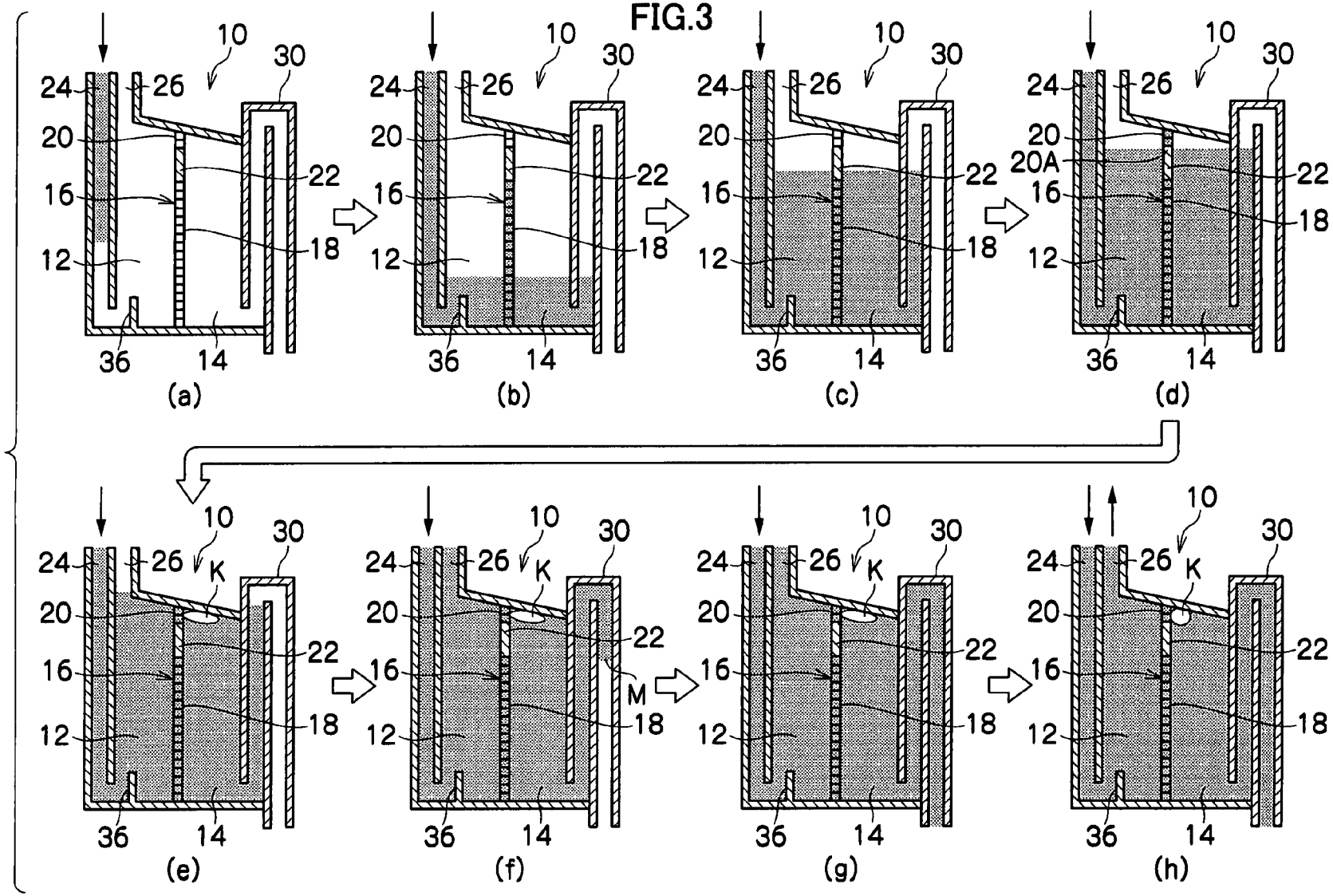
FIG. 3 is a drawing showing, in order, states at a time of filling ink into the filter unit of FIG. 1.

As shown in FIGS. 3(*a*) and (*b*), ink is poured into the first ink chamber 12 of the filter unit 10 from the ink supply path 24, and the ink is gradually filled into the first ink chamber 12 and the second ink chamber 14.

At this time, when the lower end portion of the filter 16 which partitions the first ink chamber 12 and the second ink chamber 14 is submerged in the ink, the ink seeps toward the upper portion of the filter due to capillary action. However, the filter 16 is formed from the upper filter 20 and the lower filter 18, and the partitioning portion 22 is provided therebetween. Accordingly, the lower filter 18 is wet by the ink, but because the seeping of the ink stops at the partitioning portion 22, the upper filter 20 is maintained in a state of not being wet. Therefore, air can enter and exit between the first ink chamber 12 and the second ink chamber 14 via the upper filter 20. Accordingly, the air within the second ink chamber 14 is discharged from the ink circulating path 26 via the first ink chamber 12.

Accordingly, as shown in FIG. 3(*c*), the first ink chamber 12 and the second ink chamber 14 are gradually filled in a state in which the same liquid surfaces are maintained therein. Further, ink is filled into the ink feed-out path 30 as well in a state in which the substantially the same liquid surface as in the first ink chamber 12 and the second ink chamber 14 is maintained therein. Note that the air discharge resistance of the ink feed-out path 30, which is connected to the inkjet recording head 02 (see FIG. 1), is greater than that of the ink circulating path 26. Because the air within the ink feed-out path 30 comes-out through the inkjet recording head 02, the liquid surface is slightly lower than in the first ink chamber 12 and the second ink chamber 14.

As shown in FIG. 3(*d*), when the liquid surface of the ink exceeds the partitioning portion 22 and reaches the bottom end of the upper filter 20, the ink seeps toward the upper portion of the upper filter 20 due to capillary action, and the entire surface of the upper filter 20 is wet with ink before the first ink chamber 12 and the second ink chamber 14 are filled with ink. At this time, for the first time, the flow of air between the first ink chamber 12 and the second ink chamber 14 is cut-off.

Figure 15:
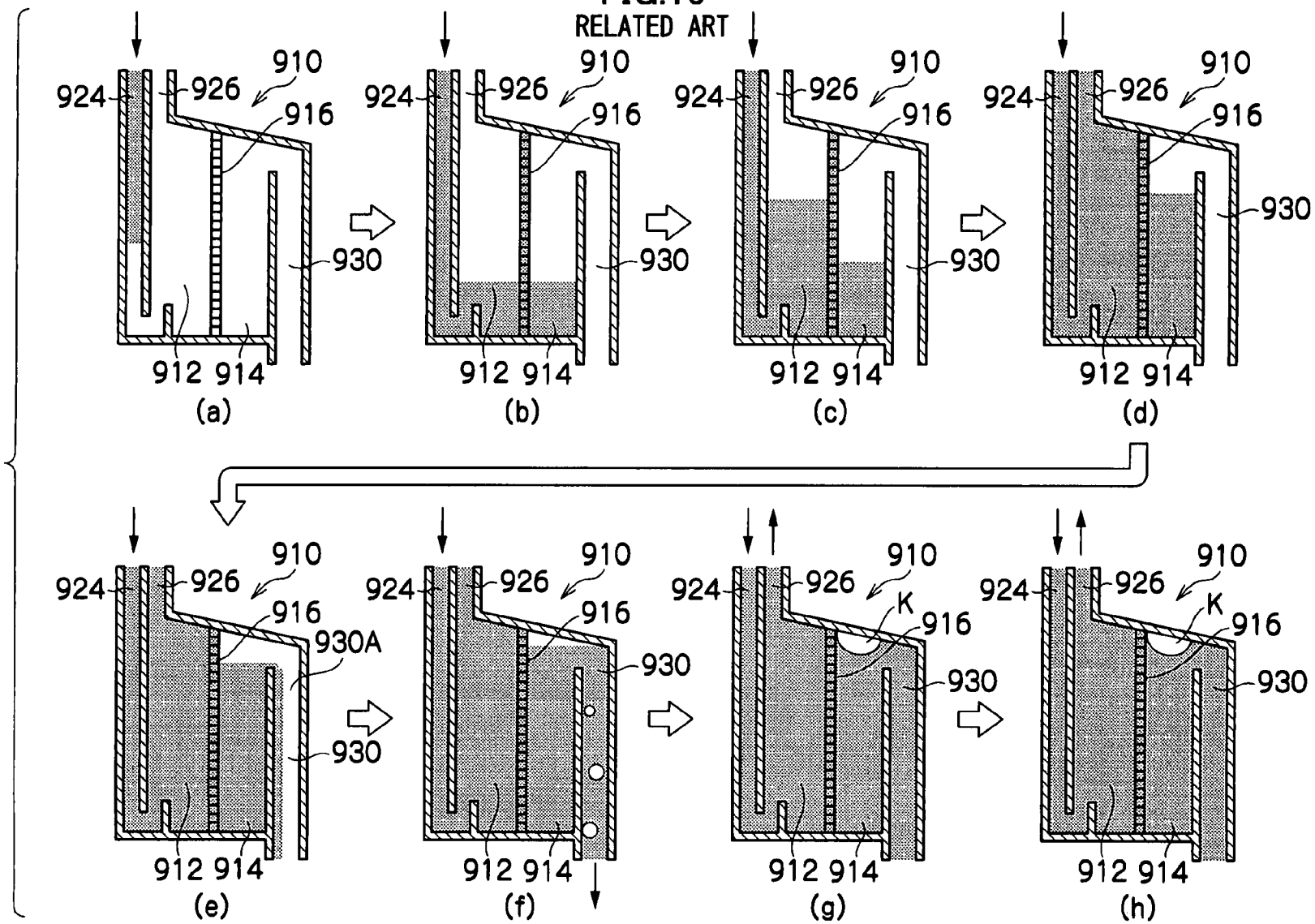
FIG.15 RELATED ART
FIG. 15 is a drawing showing, in order, states at a time of filling ink into the conventional filter unit of FIG. 14.
Figure 16:
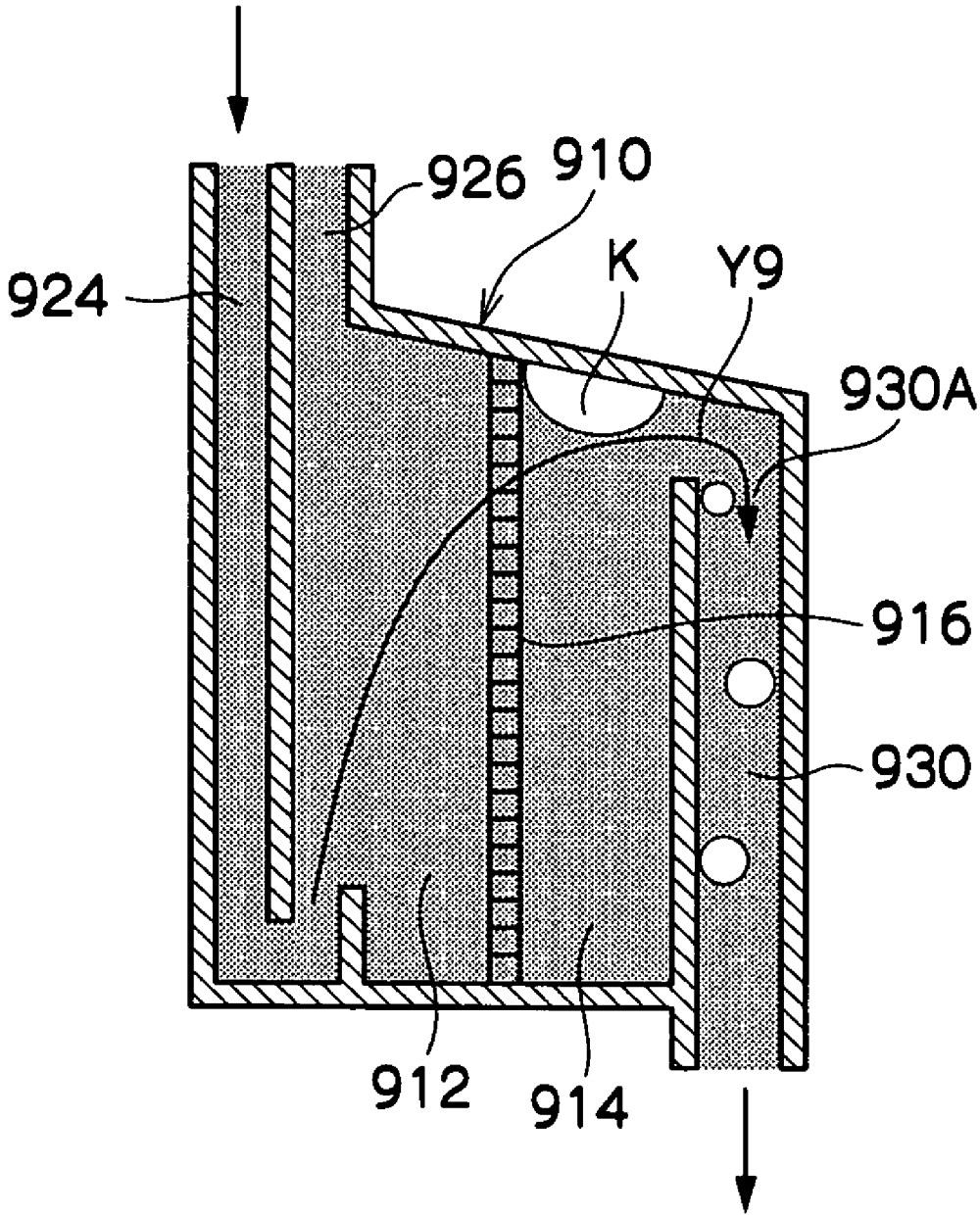
FIG.16 RELATED ART
FIG. 16 is a drawing showing the flow of ink in the conventional filter unit of FIG. 14 into which ink has been filled.

However, as shown in FIG. 3(*e*), ink is already sufficiently filled in the second ink chamber 14 at this time, and the amount of air K remaining within the second ink chamber 14 is very small (compare FIG. 3(*e*) and FIG. 15(*e*)).

As shown in FIG. 3(*f*), when the first ink chamber 12 and the second ink chamber 14 are filled with ink, the supply of ink from the ink feed-out path 30 to the inkjet recording head 02 begins. At this time, because the cross-sectional surface area of the ink feed-out path 30 is greater than or equal to 3 $mm^2$ and less than or equal to 12 $mm^2$, the ink is fed with a meniscus M thereof being maintained as is. Therefore, ink is poured into the inkjet recording head 02 in a state in which hardly any air is mixed therein (compare FIGS. 3(*e*), (*f*), and (*g*) with FIGS. 15(*e*) and (*f*)). Moreover, as shown in FIGS. 3(*g*) and (*h*), only a slight amount of the air K remains.

The flow of the ink after filling will be described next.

Figure 4:
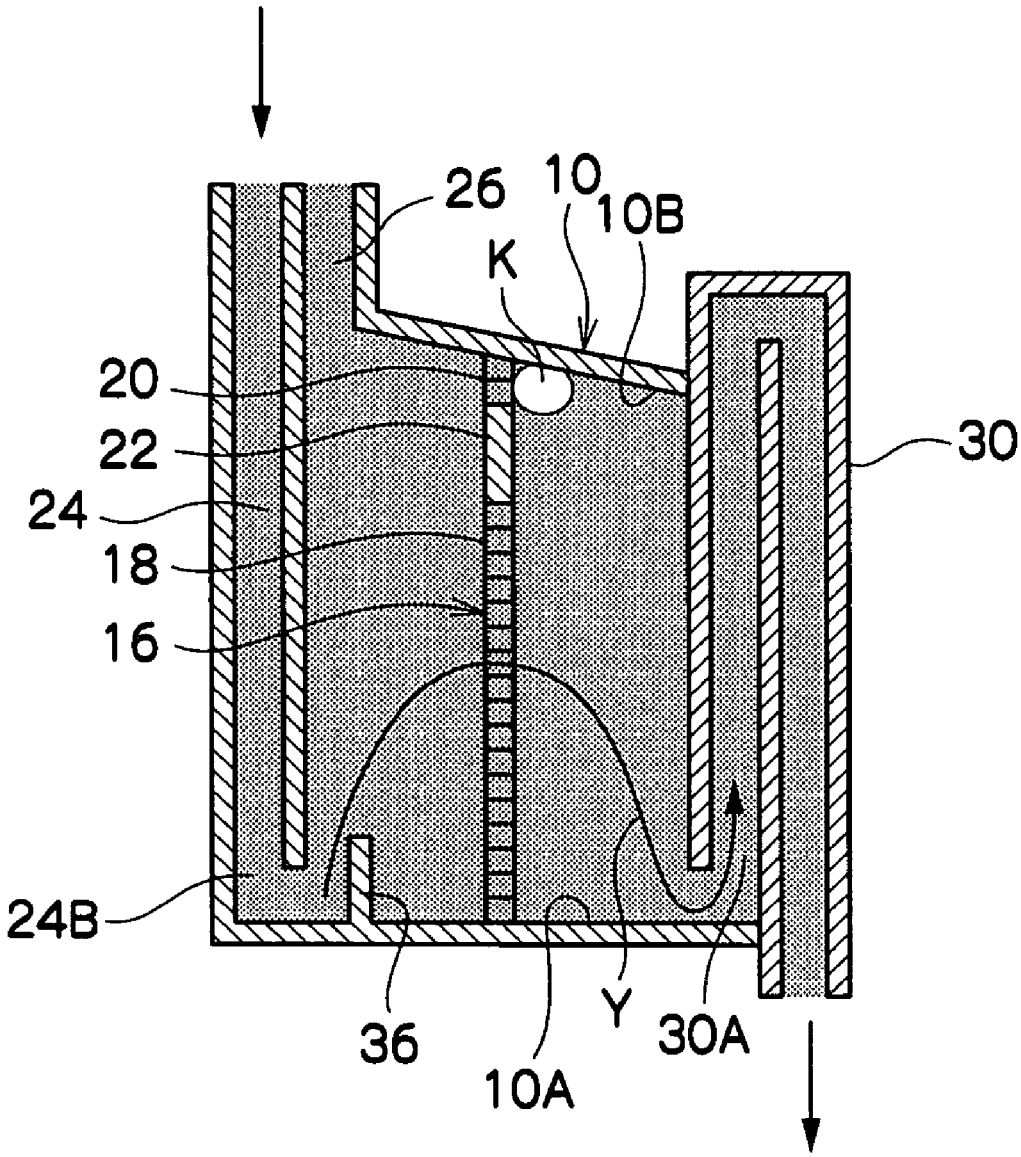
FIG. 4 is a drawing showing the flow of ink in the filter unit of FIG. 1 into which ink has been filled.

As shown in FIG. 4, because the feed-out path entrance 30A of the ink feed-out path 30 opens in a vicinity of the floor portion 10A, the remaining air K is very far from the feed-out path entrance 30A of the ink feed-out path 30. Therefore, at the time of an ink suction operation which sucks ink from the nozzles of the inkjet recording head 02, or the like, there are hardly any cases in which the air bubble K remaining in the second ink chamber 14 enters into the ink flow path 30 from the flow path entrance 30A.

In this way, there is very little of the air which remains in the filter unit 10, and moreover, there are very few occurrences of air (air bubbles) flowing-out together with the ink to the inkjet recording head 02. Accordingly, reliability does not deteriorate due to air remaining in the filter unit 10 flowing-out and flowing into the inkjet recording head 02.

Further, it is best that the ink be fed from the first ink chamber 12 to the second ink chamber 14 through as wide of a region of the filter 16 as possible. Accordingly, in the present exemplary embodiment, by creating a rising flow in the flow of the ink by the flow regulating plate 36 as shown by arrow Y, the ink can be prevented from flowing from the supply path exit 24B of the ink supply path 24 along the floor portion 10A to the feed-out path entrance 30A of the ink feed-out path 30, and the ink is fed from the first ink chamber 12 to the second ink chamber 14 through as wide a region of the filter 16 as possible.

FIG. 5 is a table which compiles various conditions required of a filter unit (filter device) for the inkjet recording head 02 (ink drop ejecting head). Note that FU in FIG. 5 is an abbreviation for filter unit, and JS is an abbreviation for inkjet recording head.

As can be understood from this table, the conventional filter unit cannot sufficiently satisfy some of these various conditions. In contrast, the filter unit 10 of the present exemplary embodiment can sufficiently satisfy all of these conditions. As a result, the reliability and maintainability of the inkjet recording head 02 can be greatly improved.

Note that the present invention is not limited to the above-described exemplary embodiment.

Figure 6:
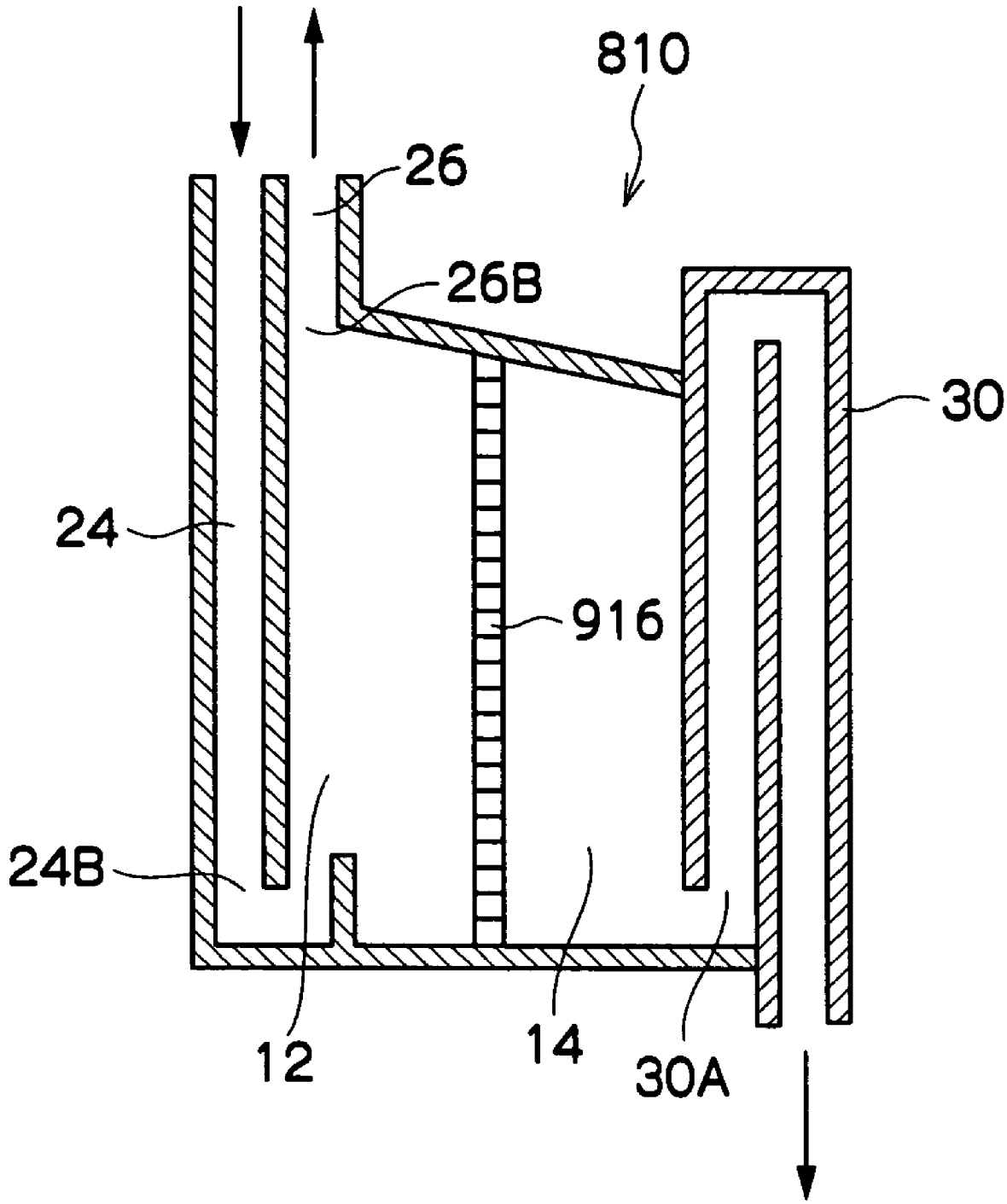
FIG. 6 is a drawing showing a first modified example of the filter unit relating to the exemplary embodiment of the present invention.

For example, as shown in FIG. 6, a filter unit 810 of a first modified example, which uses the conventional filter 916 which is not separated into an upper portion and a lower portion, may be used.

In this structure, when the lower end portion of the filter 916 which partitions the first ink chamber 12 and the second ink chamber 14 is submerged in the ink, the ink seeps toward the upper portion of the filter 916 due to capillary action. The entire surface of the filter 916 is wet by the ink before the first ink chamber 12 and the second ink chamber 14 are filled with ink. When the entire surface of the filter 916 is wet by ink, the entry and exit of air between the first ink chamber 12 and the second ink chamber 14 via the filter 916 is impeded. Therefore, air within the second ink chamber 14 cannot be discharged-out through the ink circulating path 26. Accordingly, the air within the second ink chamber 14 can only be discharged-out through the inkjet recording head 02 which has a high discharge resistance.

Accordingly, the first ink chamber 12, from which air is discharged from the ink circulating path 26 which has little resistance, is filled with ink first. Therefore, the second ink chamber 14 is filled with ink after the first ink chamber 12 is filled with ink. Accordingly, the amount of air remaining in the second ink chamber 14 increases more than in the filter unit 10 of the above-described exemplary embodiment.

However, as described above, because the feed-out path entrance 30A of the ink feed-out path 30 opens in a vicinity of the floor portion 10A, the remaining air K is very far from the feed-out path entrance 30A of the ink feed-out path 30. Accordingly, at the time of an ink suction operation which sucks ink from the nozzles of the inkjet recording head 02, or the like, there are hardly any cases in which the air K remaining in the second ink chamber 14 enters into the ink flow path 30 from the flow path entrance 30A (see FIG. 4).

Figure 7:
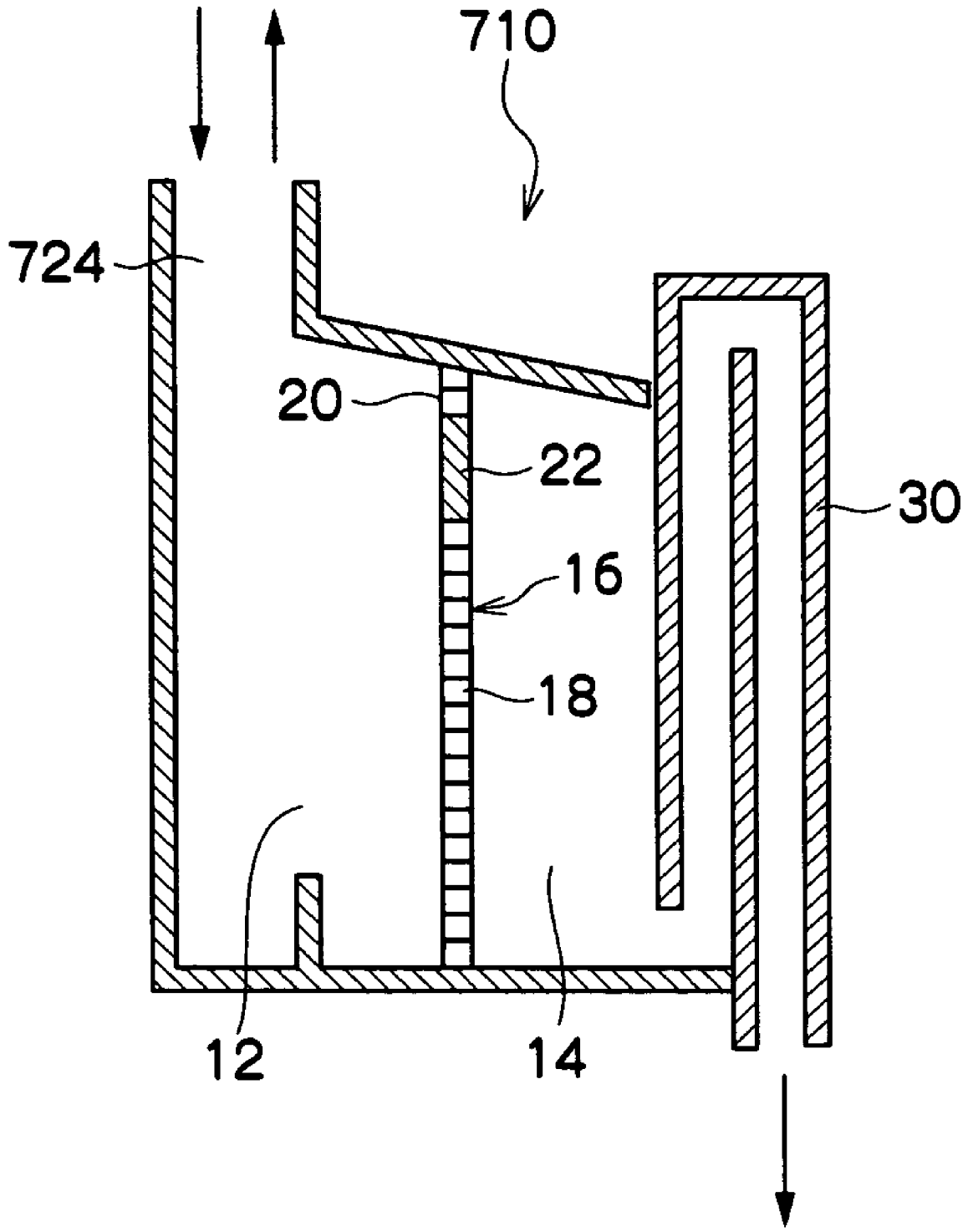
FIG. 7 is a drawing showing a second modified example of the filter unit relating to the exemplary embodiment of the present invention.

Moreover, as shown in FIG. 7, a filter unit 710 of a second modified example, which does not have the ink circulating path 26, may be used. In this case, the discharging of the air of the first ink chamber 12 is carried out from an ink supply path 724.

Examples of the present invention will be described next.

FIRST EXAMPLE

Figure 8:
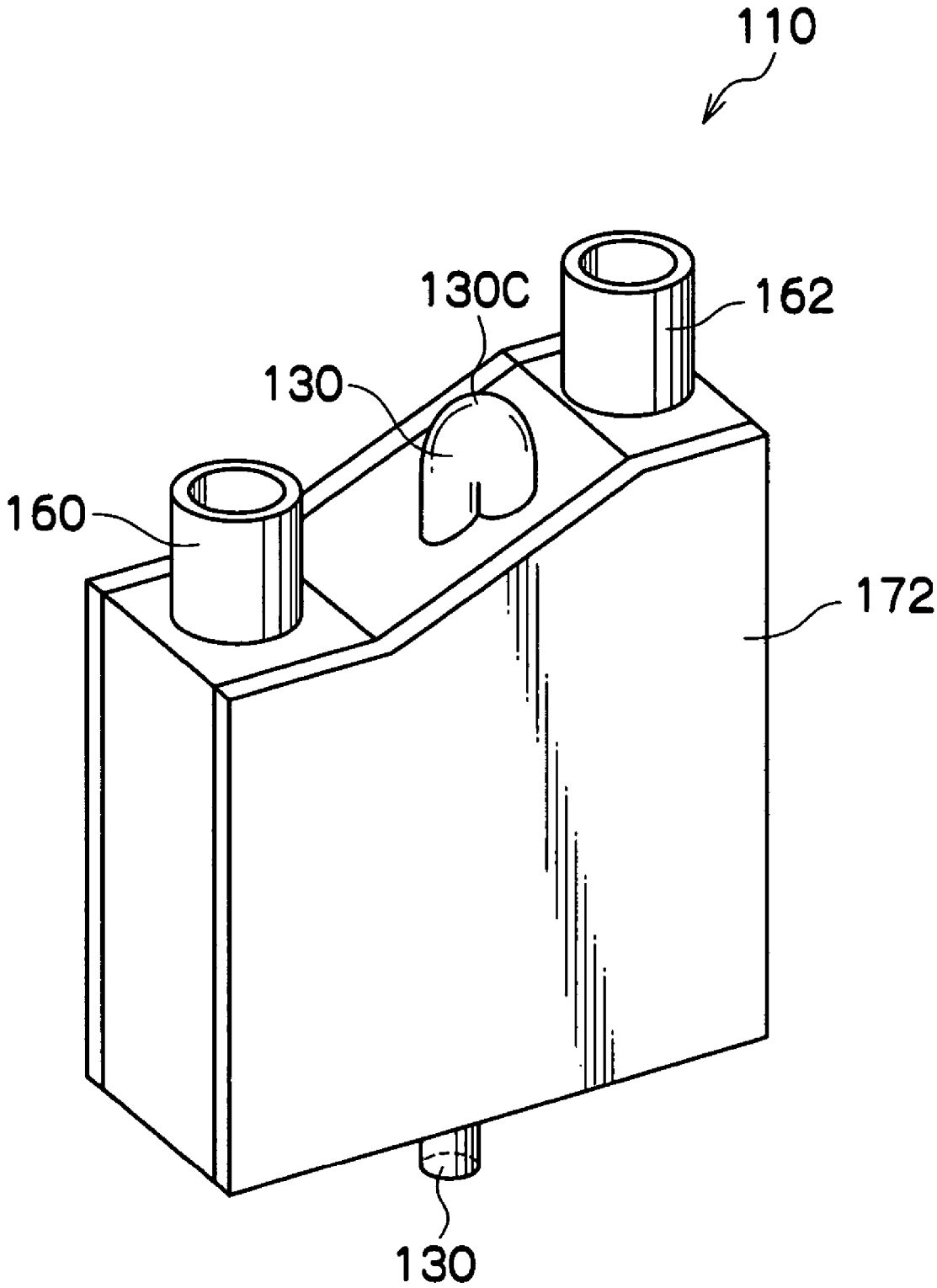
FIG. 8 is a perspective view showing the exterior of a filter unit of a first example.

As shown in FIG. 8, a filter unit 110 of a first example is formed overall in the shape of a flat, substantially trapezoidal box. The filter unit 110 is structured as a unit by the respective structural members thereof being assembled integrally. In this state of being made into a unit, the filter unit 110 is used by being connected to an ink flow path between an inkjet recording head and an ink cartridge which are installed in an inkjet recording device.

Figure 9:
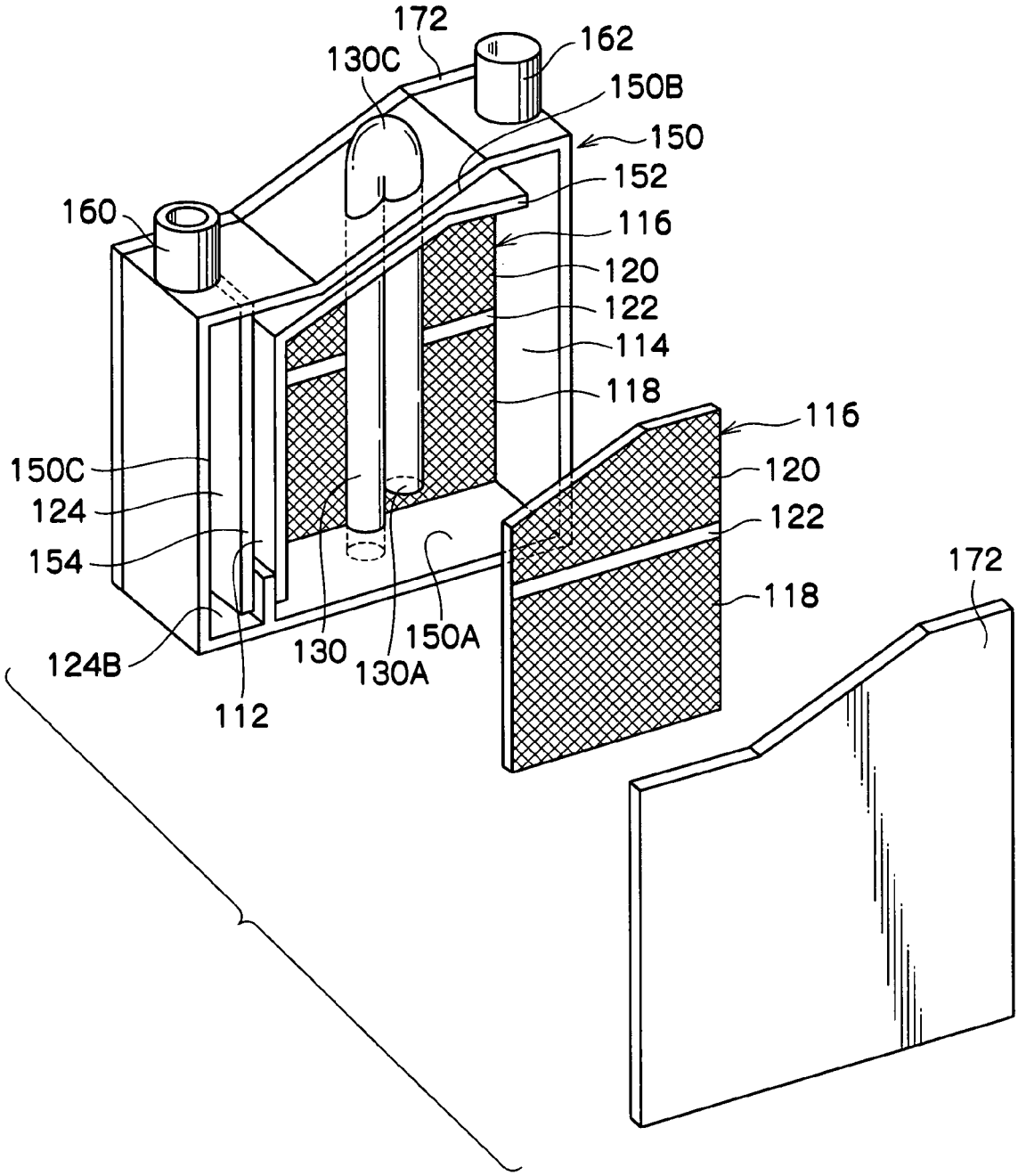
FIG. 9 is an exploded perspective view showing a disassembled state of the filter unit of FIG. 8.

As shown in FIG. 9 as well, the filter unit 110 has a case main body 150, two side plate members 172, and two filters 116.

The both side surfaces of the case main body 150 are open, and the interior thereof is hollow. The left portion and the right portion at the top surface of the case main body 150 are substantially horizontal surfaces, and the right portion is slightly higher than the left portion. An inclined surface, which is inclined upwardly from the left side toward the right side, is formed between the left portion and the right portion.

A partitioning wall 152 is formed within the case main body 150, with predetermined intervals between the partitioning wall 152 and a ceiling portion 150B and between the partitioning wall 152 and a front inner wall surface portion 150C. The width of the partitioning wall 152 is narrower than the width of the case main body 150. The filters 116 are affixed to the partitioning wall 152. Accordingly, the two filters 116 are disposed so as to oppose one another and be substantially parallel to one another. The side plate members 172 are affixed to the both side surfaces of the case main body 150. Note that FIG. 9 illustrates a state in which only one of the filters 116 and only one of the side plate members 172 are affixed.

Figure 10B:
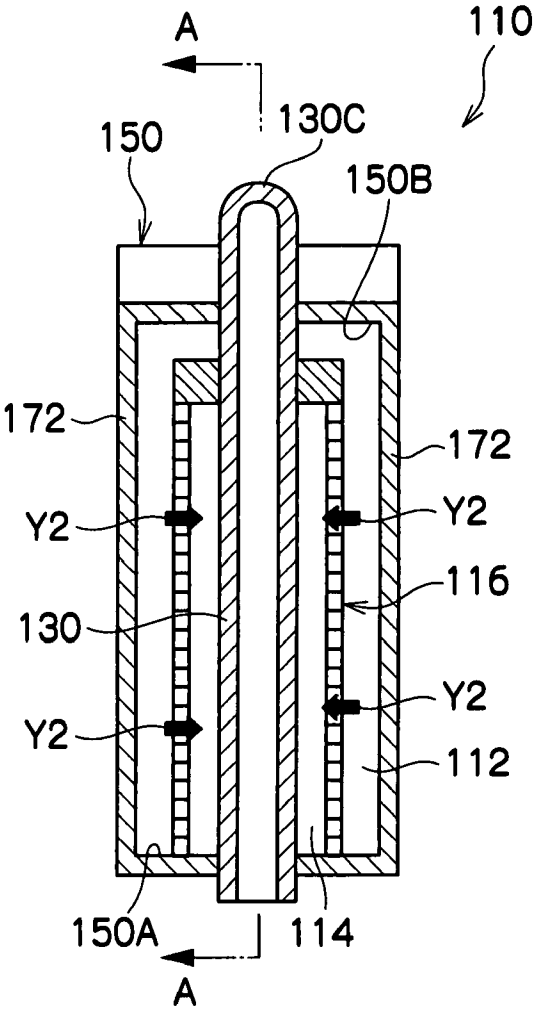
FIG. 10B is a cross-sectional view taken along line B-B of FIG. 10A, and showing a cross-section of the filter unit of FIG. 8.
Figure 10A:
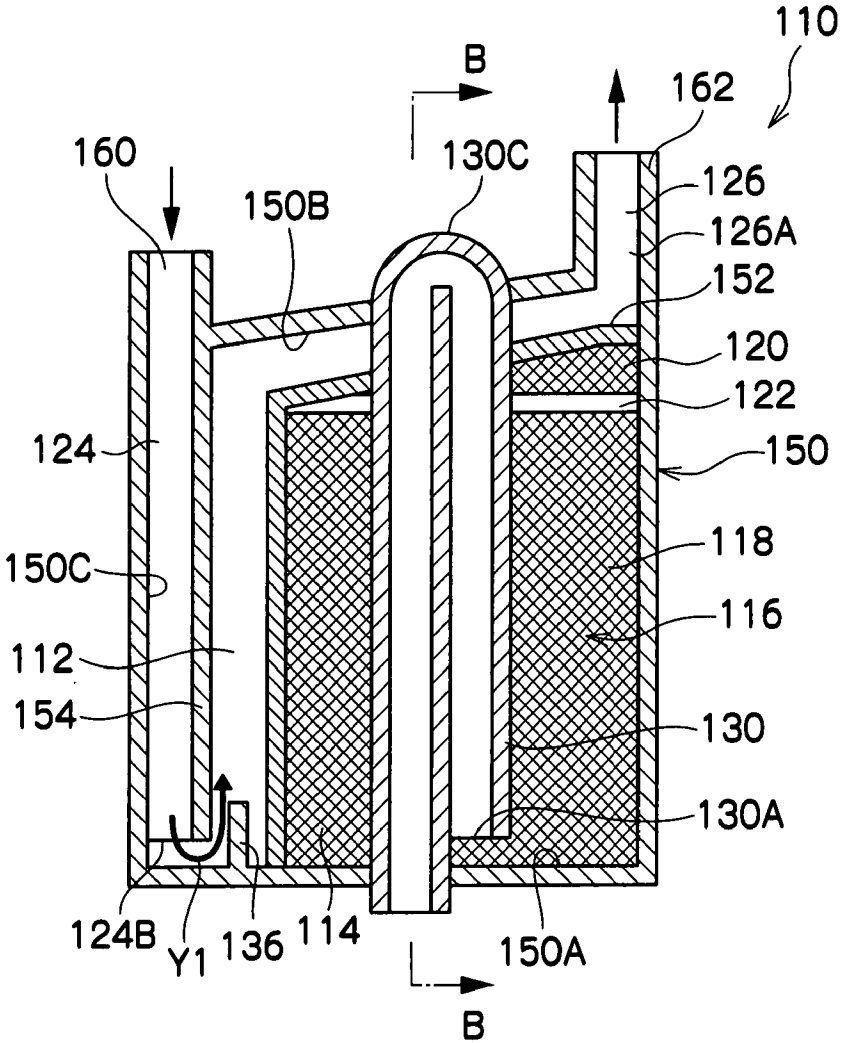
FIG. 10A is a cross-sectional view taken along line A-A of FIG. 10B, and showing a cross-section of the filter unit of FIG. 8.

Due to such a structure, as shown in FIGS. 10A and 10B as well, an inner chamber 114 which is sandwiched between the filters 116 is formed, and an outer chamber 112 is formed at the outer side of the inner chamber. Namely, the inner chamber 114 is sandwiched by the outer chamber 112. Further, the filters 116 are provided at the boundary surfaces of the inner chamber 114 and the outer chamber 112. Note that the outer chamber 112 corresponds to the first ink chamber 12 described in the above-described exemplary embodiment, whereas the inner chamber 114 corresponds to the second ink chamber 14 (refer to FIG. 1).

The filter 116 is structured by an upper filter 120 and a lower filter 118, and a partitioning portion 122 which partitions the upper filter 120 and the lower filter 118.

A partitioning wall 154 is provided between the front portion of the partitioning wall 152 and the front inner wall surface portion 150C. The partitioning wall 154 is suspended downward from the ceiling portion 150B, and is formed such that there is an interval between a floor portion 150A and the bottom end of the partitioning wall 154. The width of the partitioning wall 154 is the same as the width of the case main body 150. The space between the partitioning wall 154 and the front inner wall surface portion 150C is an ink supply path 124. A supply path exit 124B is the gap between the bottom end of the partitioning wall 154 and the floor portion 150A.

A flow regulating plate 136 is provided between the partitioning wall 152 and the partitioning wall 154. The flow regulating plate 136 stands upright from the floor portion 150A, and the top end of the flow regulating plate 136 is positioned higher than the supply path exit 124B.

A cylindrical tube portion 160 projects at the left portion of the top surface of the case main body 150. The tube portion 160 communicates with the ink supply path 124.

A cylindrical tube portion 162 projects at the right portion of the top surface of the case main body 150 as well. The tube portion 162 opens at the ceiling portion 150B. The tube portion 162 is an ink circulating path 126, and the opening of the ceiling portion 150B is a circulating path entrance 126A.

An ink feed-out path 130, which is configured as a pipe being bent in an upside-down U-shape, is disposed in a vicinity of the substantial center of the inner chamber 114. A feed-out path entrance 130A, which is one end portion of the ink feed-out path 130, opens slightly above the floor portion 150A. The other end portion of the ink feed-out path 130 passes through the floor portion 150A and projects-out, and is connected to an inkjet recording head (not shown). Further, a convex portion of the ink feed-out path 130 passes through the ceiling portion 150B and projects-out. Accordingly, a height of a convex peak portion 130C of the ink feed-out path 130 (the highest position of the ink feed-out path 130) is higher than the circulating path entrance 126A of the ink circulating path 126.

Note that the cross-sectional surface areas of the ink supply path 124, the ink circulating path 126, and the ink feed-out path 130 are 4.9 $mm^2$. (The ink feed-out path 130 is a circular conduit of an inner diameter of 2.5 mm.) A meniscus is stably maintained in the ink flowing therethrough.

The flow of ink of the filter unit 110 will be described next, although some of the description will be redundant with that of the exemplary embodiment.

Ink of an ink tank (not shown) is fed to the ink supply path 124 from the tube portion 160. The ink exits from the supply path exit 124B of the ink supply path 124. The flow of the ink is changed to an upward flow by the flow regulating path 136 (refer to arrow Y1 in FIG. 10A). Then, the inner chamber 114 and the outer chamber 112 are filled with ink. At this time, when the lower end portions of the filters 116 which separate the inner chamber 114 and the outer chamber 112 are immersed in the ink, the ink seeps toward the upper portions of the filters due to capillary action. However, the filters 116 are formed from the upper filters 120 and the lower filters 118, and the partitioning portions 122 are provided therebetween. Accordingly, although the lower filters 118 are wet by ink, because the seepage of ink stops at the partitioning portions 22, the upper filters 120 are maintained in a state of not being wet. Thus, air can enter and exit between the inner chamber 114 and the outer chamber 112 via the upper filters 120. Accordingly, the air within the inner chamber 114 is discharged-out from the ink circulating path 126 via the outer chamber 112 (corresponding to FIGS. 3(*a*) and (*b*) of the exemplary embodiment).

Accordingly, the inner chamber 114 and the outer chamber 112 are gradually filled in a state in which the liquid surfaces thereof are maintained the same. Further, ink is filled in the ink feed-out path 130 as well, in a state in which the liquid surface thereof is maintained substantially the same as in the inner chamber 114 and the outer chamber 112 (corresponding to FIG. 3(*c*) of the exemplary embodiment).

When the liquid surface of the ink exceeds the partitioning portions 122 and reaches the lower ends of the upper filters 120, the ink seeps toward the upper portions of the upper filters 120 due to capillary action, and the entire surfaces of the upper filters 120 are wet with ink before the inner chamber 114 and the outer chamber 112 are filled with ink. This is the first time that the flow of air between the inner chamber 114 and the outer chamber 112 is cut-off (corresponding to FIG. 3(*d*) of the exemplary embodiment).

However, ink is already sufficiently filled in the inner chamber 114 at this time, and the amount of air remaining in the inner chamber 114 is very small (corresponding to FIG. 3(*e*) of the exemplary embodiment).

When the outer chamber 112 and the inner chamber 114 are filled with ink, the supply of ink from the ink feed-out path 130 to the inkjet recording head begins. At this time, because the cross-sectional surface area of the ink feed-out path 130 is 4.9 $mm^2$ (an inner diameter of 2.5 mm), the ink is fed with the meniscus of the ink maintained as is. Therefore, the ink is poured into the inkjet recording head in a state in which hardly any air is mixed therein (corresponding to FIG. 3(*f*) of the exemplary embodiment). Moreover, only a slight amount of air remains in the inner chamber 114 (corresponding to FIGS. 3(*g*) and (*h*) of the exemplary embodiment).

The feed-out path entrance 130A of the ink feed-out path 130 opens in a vicinity of the floor portion 150A. Accordingly, the air which remains in a vicinity of the ceiling portion 150B of the inner chamber 114 is very far from the feed-out path entrance 130A of the ink feed-out path 130. Therefore, at the time of an ink suction operation which sucks ink from the nozzles of the inkjet recording head, or the like, there are hardly any cases in which the remaining air enters into the ink feed-out path 130 from the feed-out path entrance 130A.

Further, due to the structure in which the inner chamber 114 is sandwiched by the outer chamber 112, the surface area of the filters 116 can be made to be large.

SECOND EXAMPLE

Figure 11:
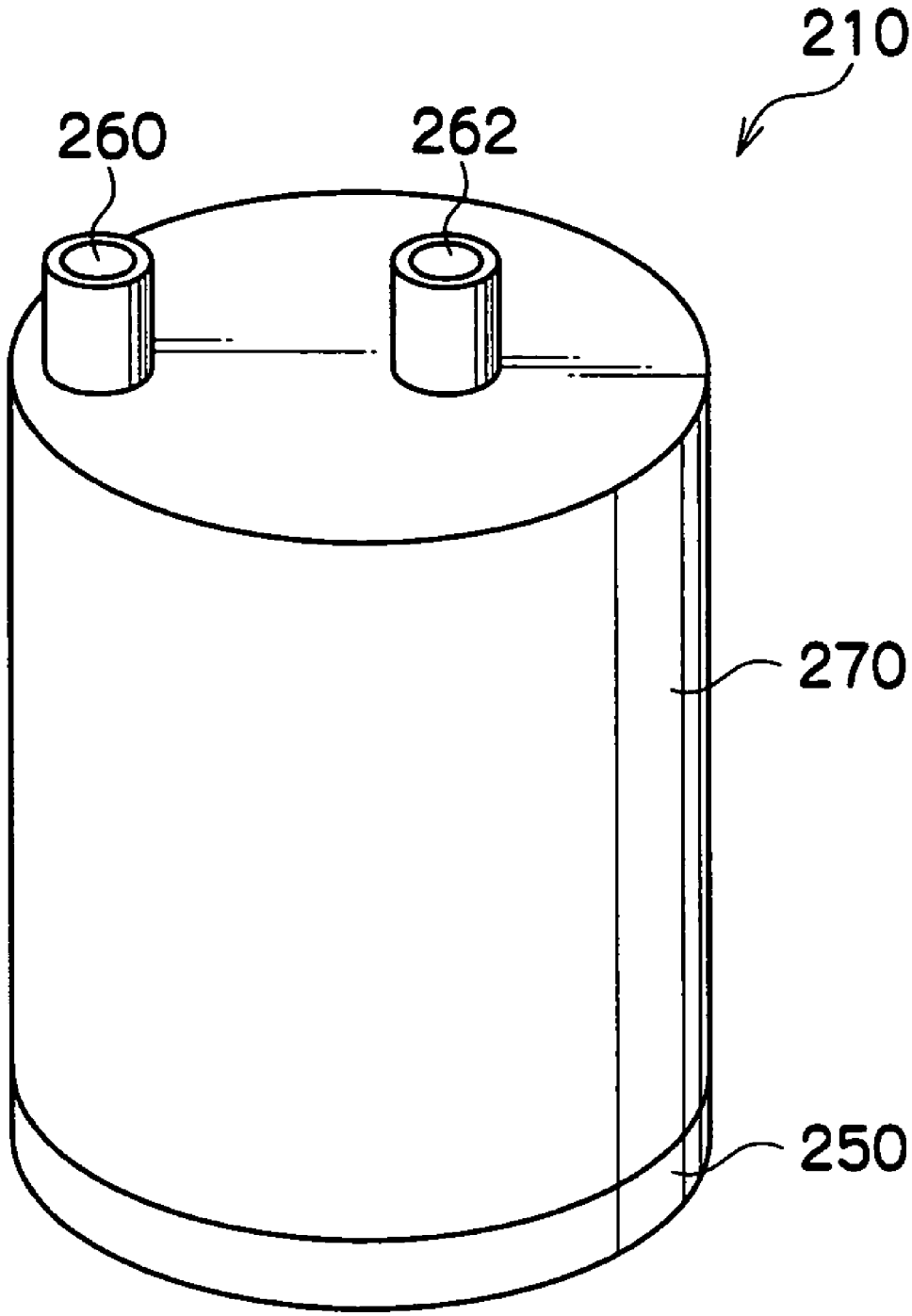
FIG. 11 is a perspective view showing the exterior of a filter unit of a second example.

As shown in FIG. 11, a filter unit 210 of a second example is formed overall in the shape of a cylindrical tube. Further, in the same way as in the first example, the filter unit 210 is structured as a unit by the respective structural members thereof being assembled integrally. In this state of being made into a unit, the filter unit 210 is used by being connected to an ink flow path between an inkjet recording head and an ink cartridge which are installed in an inkjet recording device.

Figure 12:
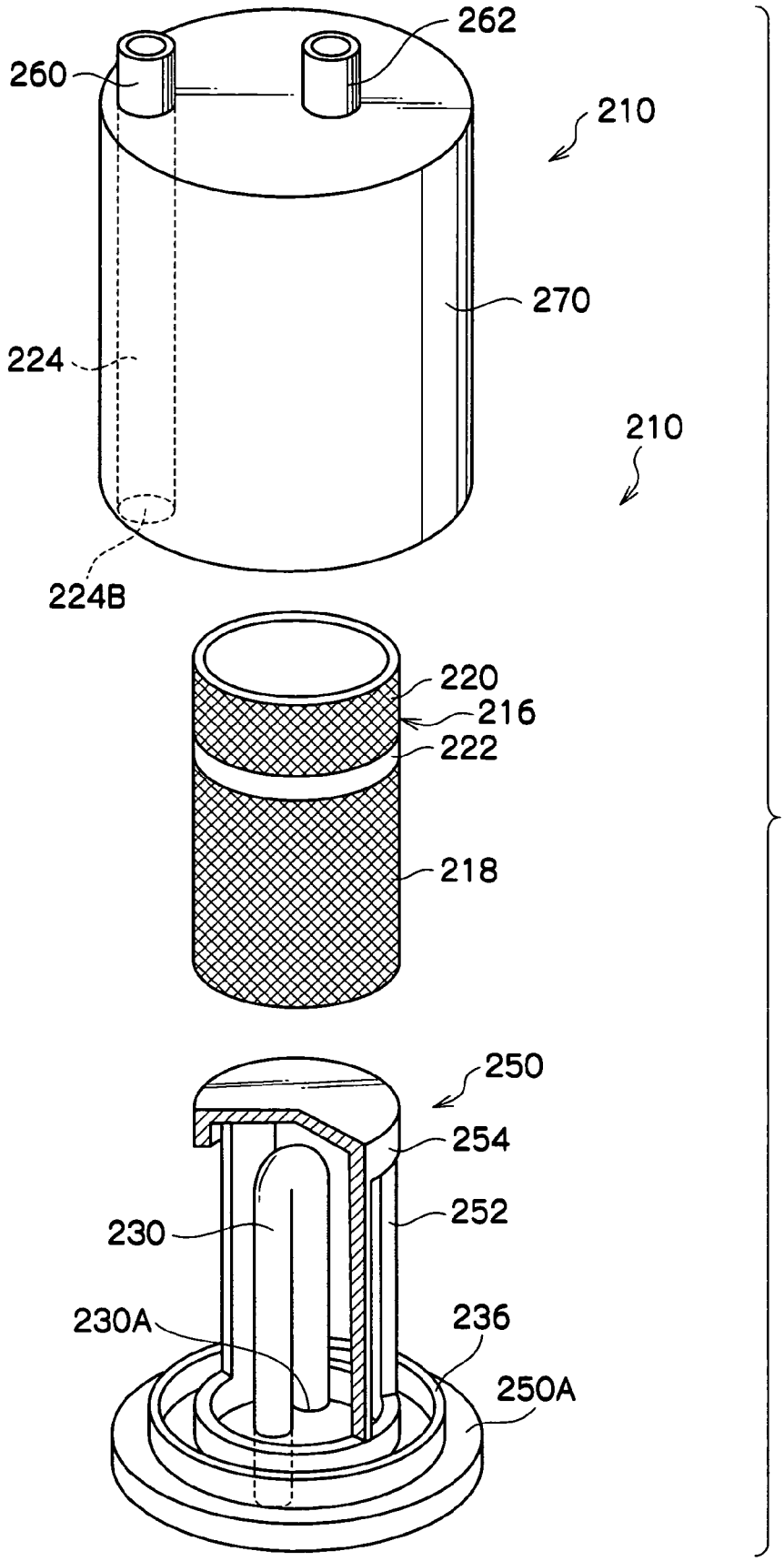
FIG. 12 is an exploded perspective view showing a disassembled state of the filter unit of FIG. 11.
Figure 13A:
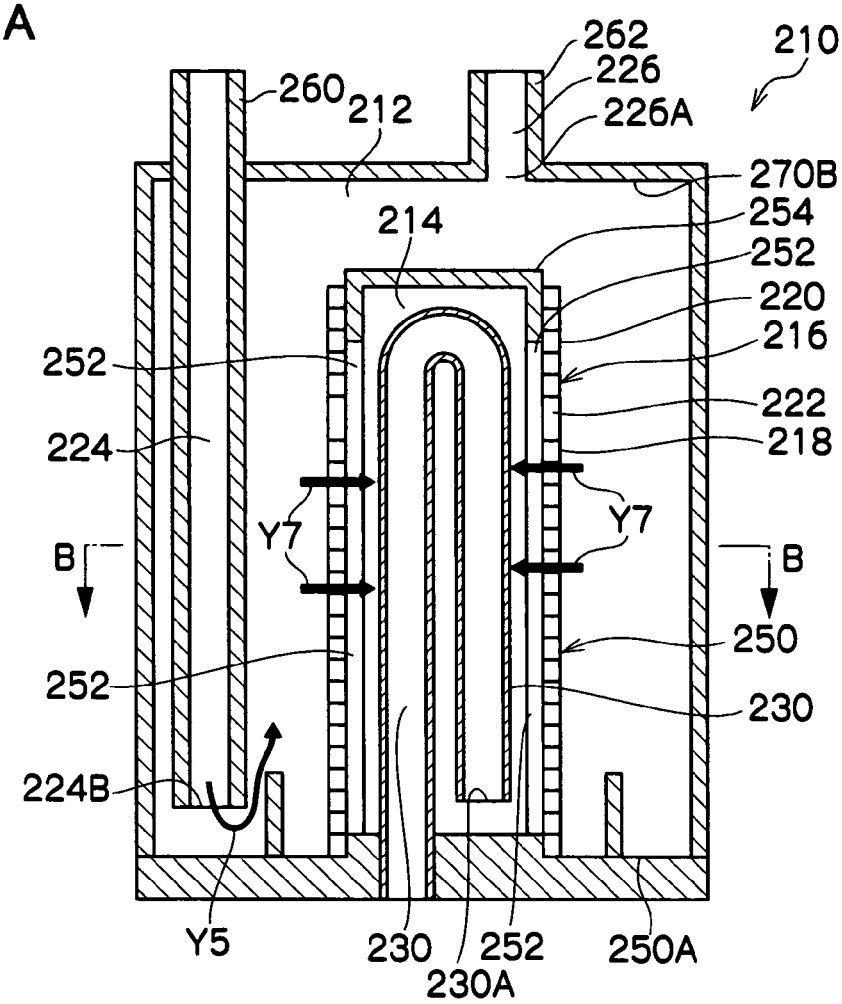
FIG. 13A is a cross-sectional view taken along line A-A of FIG. 13B, and showing a cross-section of the filter unit of FIG. 11.
Figure 13B:
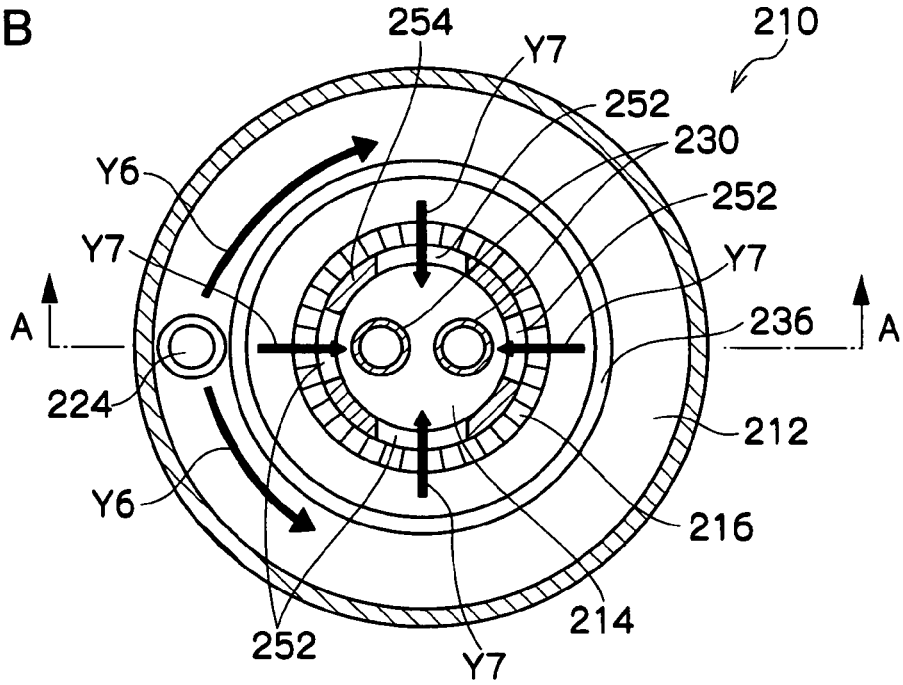
FIG. 13B is a cross-sectional view taken along line B-B of FIG. 13A, and showing a cross-section of the filter unit of FIG. 11.
Figure 14:
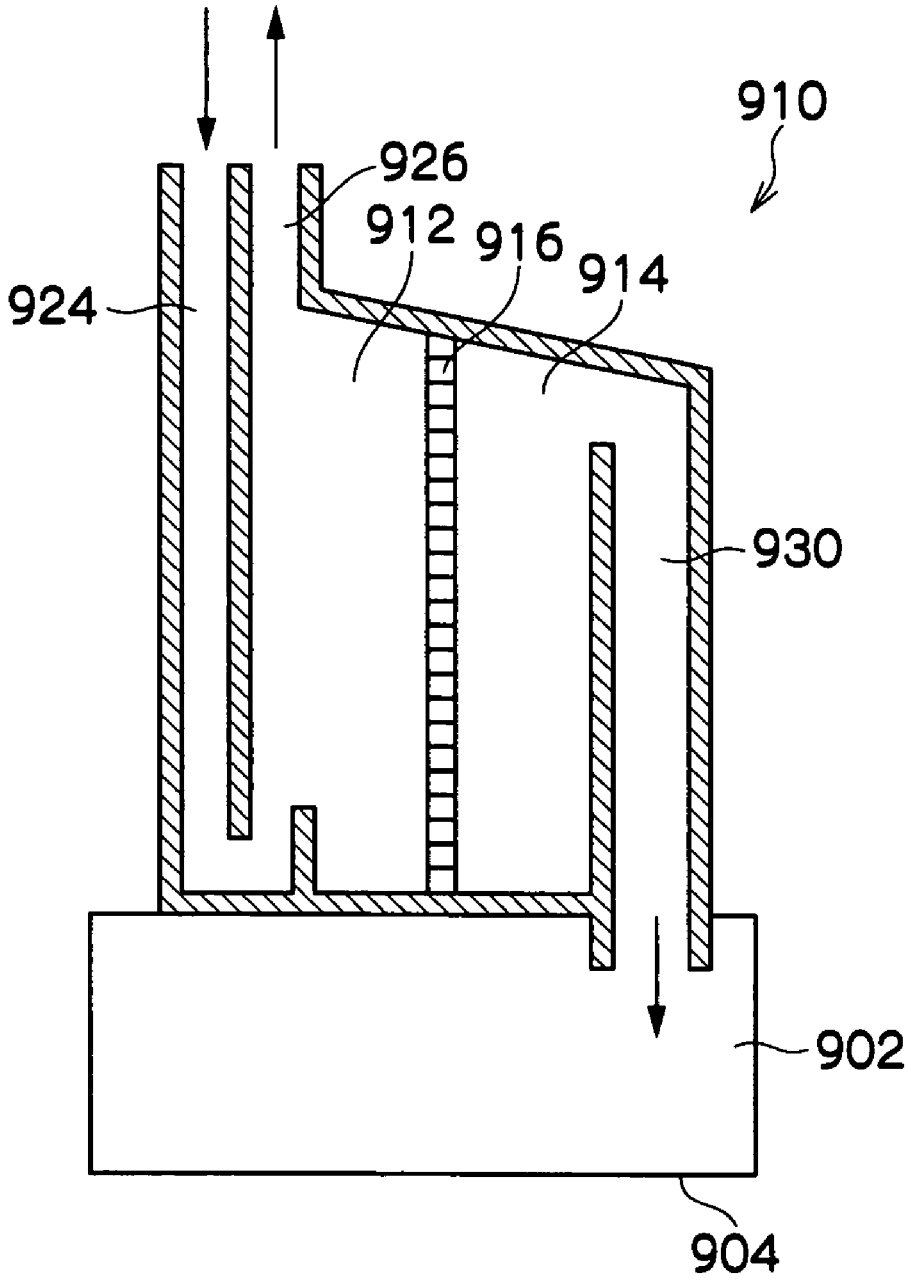
FIG.14 RELATED ART
FIG. 14 is a drawing schematically showing the structure of a conventional filter unit.

As shown in FIGS. 12, 13A and 13B, the filter unit 210 is formed from a lid member 270, a case main body portion 250, and a filter 216.

The bottom surface of the lid member 270 opens in a circular shape, and the interior of the lid member 270 is shaped as a hollow cylindrical tube. A tube portion 260 and a tube portion 262 project from the top portion of the lid member 270. The tube portion 260 extends to the interior, and is an ink supply path 224. The opening thereof is a supply path exit 224B. The tube portion 262 is an ink circulating path 226, and an opening of a ceiling portion 270B is a circulating path entrance 226A.

The case main body portion 250 has a disc-shaped floor portion 250A. A cylindrical tube portion 254, in whose side surface are formed plural rectangular openings 252 which are long in the vertical direction, is provided at the floor portion 250A. The top portion of the cylindrical tube portion 254 is lower than the ceiling portion 270B of the lid member 270.

An ink feed-out path 230, which is configured as a pipe which is bent in an upside-down U-shape, is disposed within the cylindrical tube portion 254. A feed-out path entrance 230A, which is one end portion of the ink feed-out path 230, opens slightly above the floor portion 250A. The other end portion of the ink feed-out path 230 passes through the floor portion 250A and projects-out, and is connected to an inkjet recording head (not shown). Further, a flow regulating plate 236 stands erect from the floor portion 250A in the form of a concentric circle at the outer side of the cylindrical tube portion 254.

After the filter 216 is affixed around the cylindrical tube portion 254, the lid member 270 is placed on and joined to the case main body portion 250.

When assembly has been carried out in this way, an inner chamber 214 of the interior of the cylindrical tube portion 254 is within an outer chamber 212 which is between the cylindrical tube portion 254 and the lid member 270. Note that the inner chamber 214 corresponds to the second ink chamber 14 of the exemplary embodiment, whereas the outer chamber 212 corresponds to the first ink chamber 12 of the exemplary embodiment.

The filter 216, which separates the inner chamber 214 and the outer chamber 212, is structured from an upper filter 220 and a lower filter 218, and a partitioning portion 222 which partitions the upper filter 220 and the lower filter 218.

Description of the flow of ink will be omitted as it would be redundant with that of the exemplary embodiment and the first example.

Due to such a structure, the ink of the ink supply path 224 creates an upward flow due to the flow regulating plate 236 as shown by arrow Y5 of FIG. 13A, and the ink flows over the entire periphery of the outer chamber 212 as shown by arrows Y6 in FIG. 13B. Moreover, the ink flows from the openings 252 through the filter 216 to the inner chamber 214 as shown by arrows Y7.

Due to the cylindrical configuration, the ink flows-in from the outer chamber 212 through the filter 216 into the inner chamber 214, and the flow speed of the ink heading toward the ink feed-out path 230 is the same in all directions. In this way, there are fewer stagnant portions which arise at the time when the ink flows, and the ability to discharge air is good.

Note that the present invention is not limited to the above-described exemplary embodiment and examples.

For example, the filter device is not limited to an inkjet recording device, and can also be applied to other liquid drop ejecting devices such as a pattern forming device which ejects liquid drops in order to form a pattern of a semiconductor or the like, or the like.

In the filter device of the present invention, the liquid flows from the supply path into the first liquid chamber, and then flows into the second liquid chamber. At this time, when the liquid flows from the first liquid chamber to the second liquid chamber, the liquid passes through the filter provided between the first liquid chamber and the second liquid chamber. Foreign matter, such as refuse or the like, existing in the liquid is thereby caught by the filter, and is removed from the liquid. Then, the liquid is discharged from the first discharge path.

The intermediate portion of the first discharge path between the entrance and the exit of the first discharge path, is higher than the entrance and the exit. Further, the entrance of the first discharge path opens in a vicinity of the floor portion of the second liquid chamber. Because the air remaining in the second liquid chamber is at the ceiling portion at the upper portion, the entrance is far from the remaining air. Accordingly, there are hardly any cases in which the air remaining in the second liquid chamber flows-in from the entrance of the first discharge path.

If the entrance is simply positioned below, i.e., if the entrance is positioned upper than the intermediate portion, in a case in which the flow of liquid stops, the liquid surface of the liquid in the filter device falls to a vicinity of the entrance. Accordingly, the filter device returns to a state in which hardly any liquid is filled in the filter device.

However, because the intermediate portion is higher than the entrance, the liquid surface only falls to the highest position portion of the intermediate portion. Accordingly, even if the entrance of the first discharge path is positioned below, a state in which liquid is filled in the filter device can be maintained.

The filter device of the present invention may have a second discharge path which communicates with the first liquid chamber.

In the above-described filter device, the second discharge path communicates with the first liquid chamber. Accordingly, because the air of the first liquid chamber can be discharged-out from the second discharge path, there is little remaining of air in the first liquid chamber.

Further, in the filter device of the present invention, an entrance of the second discharge path may open at one of a ceiling portion of the first liquid chamber and a vicinity of the ceiling portion.

In the above-described filter device, the entrance of the second discharge path opens at the ceiling portion of the first liquid chamber, or in a vicinity of the ceiling portion. Because air remains in a vicinity of the ceiling portion of the second liquid chamber, it is easy for the air to be discharged-out from the entrance of the second discharge path.

In the filter device of the present invention, the first discharge path may be formed overall in an upside-down U-shape.

In the above-described filter device, by forming the first discharge path overall in an upside-down U-shape, it is easy to form a structure in which the intermediate portion between the entrance and the exit is higher than the entrance.

Further, in the filter device of the present invention, an exit of the supply path may open in a vicinity of a floor portion of the first liquid chamber.

In the above-described filter device, because the exit of the supply path opens in a vicinity of the floor portion of the first liquid chamber, liquid is gradually filled from the floor portion of the first liquid chamber. Accordingly, there is little air which remains.

Moreover, in the filter device of the present invention, a cross-sectional surface area of the first discharge path may be made to be greater than or equal to 3 $mm^2$ and less than or equal to 12 $mm^2$.

In the above-described filter device, the cross-sectional surface area of the first discharge path is made to be greater than or equal to 3 $mm^2$ and less than or equal to 12 $mm^2$. Therefore, the liquid flowing through the first discharge path flows while maintaining a meniscus. Accordingly, air is not mixed-in with the liquid flowing through the first discharge path.

In the filter device of the present invention, a highest position portion of the intermediate portion of the first discharge path may be made to be higher than a ceiling portion of the second liquid chamber.

In the above-described filter device, because the highest position portion of the intermediate portion of the first discharge path is higher than the ceiling portion of the second liquid chamber, even at times when the flow of liquid stops, the second liquid chamber is filled with liquid without the liquid surface falling.

Moreover, in the filter device of the present invention, the second liquid chamber may be provided at an inner side of the first liquid chamber.

In the above-described filter device, by using a structure in which the outer side surface of the second liquid chamber is surrounded by the first liquid chamber, the surface area of the outer side surface is made to be large. Therefore, the surface area of the filter provided along the outer side surface can be made to be large.

In the filter device of the present invention, the first liquid chamber may be provided so as to surround an outer side surface of the second liquid chamber, and the filter may be provided along the outer side surface.

In the above-described filter device, by using a structure in which the outer side surface of the second liquid chamber is surrounded by the first liquid chamber, the surface area of the outer side surface can be made to be large. Accordingly, the surface area of the filter provided along the outer side surface also can be made to be even larger.

Moreover, in the filter device of the present invention, the second liquid chamber and the filter may be cylindrical-tube-shaped, and the first discharge path may be disposed at a substantially axially central position of the cylindrical-tube-shaped filter.

In the above-described filter device, the second liquid chamber and the filter are shaped as cylindrical tubes. By placing the flow-out path at the substantially axially central position of the filter, the flow speed of the ink, which passes through the filter and flows into the second liquid chamber and heads toward the first discharge path, is the same in any direction. In this way, there are fewer stagnant portions which arise when the ink flows, and the ability to discharge air bubbles is good. Further, when such a cylindrical-tubular filter is used, the shape of the filter is simple and manufacturing thereof is easy as compared with a case in which, for example, the outer side surface is a polygonal surface and the filter is made to be a polygonal tube, or the like.

In the filter device of the present invention, the first liquid chamber may be provided so as to sandwich the second liquid chamber, and the filter may be provided at a boundary surface of the first liquid chamber and the second liquid chamber.

In the above-described filter device, by using a structure in which the second liquid chamber is sandwiched by the first liquid chamber, the surface area of the boundary surface between the first liquid chamber and the second liquid chamber can be made to be larger. Therefore, the surface area of the filter provided at this boundary surface also can be made to be larger.

A liquid drop ejecting device of the present invention may have: a liquid drop ejecting head ejecting liquid drops from nozzles toward an object of discharge; a liquid storing section in which liquid, which is to be supplied to the liquid drop ejecting head, is stored; and a filter device which has any of the above-described structures and which is provided between the liquid drop ejecting head and the liquid storing section.

Because the above-described liquid drop ejecting device is equipped with the filter device which makes it difficult for remaining air to flow-out, deterioration in the liquid drop ejecting performance is prevented.

Further, in the liquid drop ejecting device of the present invention, the filter may be disposed at an orientation substantially orthogonal to a nozzle surface of the liquid drop ejecting head in which the nozzles are formed.

In the above-described liquid drop ejecting device, by disposing the filter at an orientation substantially orthogonal to the nozzle surface, the projected surface area of the filter onto the nozzle surface does not become large even if the surface area of the filter is made to be large.

What is claimed is:

1. A filter device comprising:

a supply path into which liquid flows;

a first liquid chamber communicating with the supply path;

a second liquid chamber communicating with the first liquid chamber;

a first discharge path that communicates with the second liquid chamber, and from which liquid is discharged; and a filter provided between the first liquid chamber and the second liquid chamber, wherein an intermediate portion of the first discharge path between an entrance and an exit of the first discharge path is higher than the entrance and the exit, the entrance of the first discharge path opens in a vicinity of a floor portion of the second liquid chamber, and an exit of the supply path opens in a vicinity of a floor portion of the first liquid chamber.

2. The filter device of claim 1, further comprising a second discharge path that communicates with the first liquid chamber.

3. The filter device of claim 2, wherein an entrance of the second discharge path opens at one of a ceiling portion of the first liquid chamber and a vicinity of the ceiling portion.

4. The filter device of claim 1, wherein the first discharge path is formed overall in an upside-down U-shape.

5. The filter device of claim 1, wherein a cross-sectional surface area of the first discharge path is greater than or equal to 3 $mm^2$ and less than or equal to 12 $mm^2$.

6. The filter device of claim 1, wherein a highest position portion of the intermediate portion of the first discharge path is higher than a ceiling portion of the second liquid chamber.

7. The filter device of claim 1, wherein the second liquid chamber is provided at an inner side of the first liquid chamber.

8. The filter device of claim 7, wherein the first liquid chamber is provided so as to surround an outer side surface of the second liquid chamber, and the filter is provided along the outer side surface.

9. The filter device of claim 8, wherein the second liquid chamber and the filter are cylindrical-tube-shaped, and the first discharge path is disposed at a substantially axially central position of the cylindrical-tube-shaped filter.

10. The filter device of claim 7, wherein the first liquid chamber is provided so as to sandwich the second liquid chamber, and the filter is provided at a boundary surface of the first liquid chamber and the second liquid chamber.

11. The filter device of claim 1, wherein the filter includes an upper filter, a lower filter, and a partitioning portion provided between the upper filter and the lower filter.

12. The filter device of claim 11, wherein the filter is provided in a vertical direction between a ceiling portion of the first and second liquid chambers and a floor portion of the first and second liquid chambers, and the partitioning portion is positioned slightly downward from the ceiling portion of the first and second liquid chambers.

13. The filter device of claim 1, wherein a flow regulating plate is provided upright at the floor portion of the first liquid chamber between the supply path and the filter.

14. A liquid drop ejecting device comprising:

a liquid drop ejecting head ejecting liquid drops from nozzles toward an object of ejection;

a liquid storing section in which liquid, which is to be supplied to the liquid drop ejecting head, is stored; and a filter device provided between the liquid drop ejecting head and the liquid storing section, the filter device having:

a supply path into which liquid flows;

a first liquid chamber communicating with the supply path;

a second liquid chamber communicating with the first liquid chamber;

a first discharge path which communicates with the second liquid chamber, and from which liquid is discharged; and a filter provided between the first liquid chamber and the second liquid chamber, wherein an intermediate portion of the first discharge path between an entrance and an exit of the first discharge path is higher than the entrance and the exit, the entrance of the first discharge path opens in a vicinity of a floor portion of the second liquid chamber, and an exit of the supply path opens in a vicinity of a floor portion of the first liquid chamber.

15. The liquid drop ejecting device of claim 14, wherein the filter is disposed at an orientation substantially orthogonal to a nozzle surface of the liquid drop ejecting head in which the nozzles are formed.

16. The liquid drop ejecting device of claim 14, further comprising a second discharge path that communicates with the first liquid chamber.

17. The liquid drop ejecting device of claim 16, wherein an entrance of the second discharge path opens at one of a ceiling portion of the first liquid chamber and a vicinity of the ceiling portion.

18. The liquid drop ejecting device of claim 14, wherein the first discharge path is formed overall in an upside-down U-shape.

* * * * *